US007352984B2

(12) United States Patent
Matsuda et al.

(10) Patent No.: US 7,352,984 B2
(45) Date of Patent: Apr. 1, 2008

(54) ELECTROPHOTOGRAPHIC ENDLESS BELT, ELECTROPHOTOGRAPHIC APPARATUS HAVING ELECTROPHOTOGRAPHIC ENDLESS BELT, AND PROCESS FOR PRODUCING ELECTROPHOTOGRAPHIC ENDLESS BELT

(75) Inventors: Hidekazu Matsuda, Shizuoka (JP); Akihiko Nakazawa, Shizuoka (JP); Atsushi Tanaka, Shizuoka (JP); Takashi Kusaba, Shizuoka (JP); Yuji Sakurai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 362 days.

(21) Appl. No.: 10/986,348

(22) Filed: Nov. 12, 2004

(65) Prior Publication Data

US 2005/0118522 A1 Jun. 2, 2005

(30) Foreign Application Priority Data

Nov. 28, 2003 (JP) ..... 2003-399887
Dec. 19, 2003 (JP) ..... 2003-422931

(51) Int. Cl.
*G03G 15/16* (2006.01)
*G03G 15/01* (2006.01)
*G03G 13/00* (2006.01)

(52) U.S. Cl. ..... 399/297; 252/500; 252/511; 399/302; 399/308; 430/31; 430/32; 430/126; 524/425; 524/430; 524/444; 524/449; 524/514; 524/538

(58) Field of Classification Search ..... 524/538, 524/514, 430, 425, 444, 449; 252/500, 511; 399/297, 302, 308; 430/31, 32, 126
See application file for complete search history.

(56) References Cited

U.S. PATENT DOCUMENTS 5,021,036 A 6/1991 Tanaka et al. ..... 474/237

FOREIGN PATENT DOCUMENTS

| | | |
|---|---|---|
| JP | 3-89357 | 4/1991 |
| JP | 5-16263 | 1/1993 |
| JP | 8-99374 | 4/1996 |
| JP | 11-352796 | * 12/1999 |
| JP | 2001-350347 | 12/2001 |
| JP | 2003-177612 | 6/2003 |

* cited by examiner

*Primary Examiner*—Ana Woodward
(74) *Attorney, Agent, or Firm*—Fitzpatrick, Cella, Harper & Scinto

(57) ABSTRACT

An electrophotographic endless belt containing a polyamide resin, carbon black and a filler, characterized in that the polyamide resin is at least one resin selected from the group consisting of polyamide 610, polyamide 612, polyamide 11 and polyamide 12, the filler is at least one filler selected from the group consisting of an oxide, a hydroxide, a carbonate and a silicate, and weight (A) of the polyamide resin and total weight (B) of the carbon black and the filler is in a ratio (A:B) of from 90:10 to 50:50. Also disclosed are an electrophotographic apparatus having the electrophotographic endless belt, and a process for producing the electrophotographic endless belt.

7 Claims, 4 Drawing Sheets

ELECTROPHOTOGRAPHIC ENDLESS BELT, ELECTROPHOTOGRAPHIC APPARATUS HAVING ELECTROPHOTOGRAPHIC ENDLESS BELT, AND PROCESS FOR PRODUCING ELECTROPHOTOGRAPHIC ENDLESS BELT

BACKGROUND OF THE INVENTION

1. Field of the Invention

This invention relates to an electrophotographic endless belt, such as a transfer material transporting belt, an intermediate transfer belt or a photosensitive belt, used in an electrophotographic apparatus, and also relates to an electrophotographic apparatus having the electrophotographic endless belt, and a process for producing the electrophotographic endless belt.

2. Related Background Art

Besides rigid-body drum-shaped members, flexible endless-belt-shaped members (electrophotographic endless belts) are conventionally used in transfer material transporting members, intermediate transfer members, electrophotographic photosensitive members, fixing members and so forth used in electrophotographic apparatuses, such as copying machines and laser beam printers.

In recent years, color (such as full-color) electrophotographic apparatuses have been put forward into practical use, and there is an increasing demand for transfer material transporting belts, intermediate transfer belts and so forth as well.

An endless belt composed chiefly of a thermoplastic resin is commonly available as the electrophotographic endless belt. The endless belt composed chiefly of a thermoplastic resin has advantages in that it can be produced at a low cost and general-purpose extruding machines can be used.

For example, Japanese Patent Application Laid-open No. H03-089357 discloses an electrophotographic endless belt making use of a polycarbonate, which is a thermoplastic resin. However, the polycarbonate resin disclosed in Japanese Patent Application Laid-open No. H03-089357 is a non-crystalline resin. Hence, the electrophotographic endless belt making use of it has poor flexing resistance.

For example, Japanese Patent Application Laid-open No. H08-099374 discloses an electrophotographic endless belt making use of polyalkylene terephthalate, which is a crystalline resin, in order to improve flexing resistance. The use of such a crystalline resin may lead to superior flexing resistance. However, where carbon black is used therein as a conducting agent, the resin may become too brittle, resulting in an electrophotographic endless belt having poor flexing resistance even though the resin itself has good flexing resistance.

Thus, in using carbon black as a conducting agent, it is necessary for the resin to have flexing resistance and also be more flexible.

Japanese Patent Application Laid-open No. H05-016263 discloses an electrophotographic endless belt making use of a polyamide resin, which is a flexible, crystalline resin. However, polyamide 6 or polyamide 66, which is a commonly available polyamide resin, has a high concentration of amide groups. Hence, the use of polyamide 6 or polyamide 66 may lead to high water absorption, causing dimensional changes or greatly varying the electrical properties due to the service environment. Thus, it has been difficult to use such a resin.

Accordingly, it may be contemplated to use, among polyamide resins, a polyamide having an especially low water absorption. However, the polyamide having a low water absorption may inevitably also have a low modulus of elasticity at the same time. When it is used alone, the resultant electrophotographic endless belt may creep (elongate) and not be durable enough for long-term service.

Japanese Patent Application Laid-open No. 2001-350347 discloses an electrophotographic endless belt making use of polyamide resin 12, having a low water absorption, and carbon black. In fact, the incorporation of carbon black as a conducting agent improves the modulus of elasticity by the virtue of its reinforcing effect, and may reduce creeping. However, its effect is not sufficient depending on the types of carbon black, and the belt has not been sufficiently durable for long-term service.

Thus, the mere use of a polyamide resin and carbon black has not been unable to provide an electrophotographic endless belt that has satisfactory creep resistance.

Japanese Patent Application Laid-open No. 2003-177612 discloses an electrophotographic endless belt making use of a polyamide resin and carbon black to which an inorganic filler has been added. In the electrophotographic endless belt disclosed in Japanese Patent Application Laid-open No. 003-177612, barium sulfate is used as the inorganic filler.

However, when barium sulfate is used as the inorganic filler, it may have an effect on dispersibility, as disclosed in Japanese Patent Application Laid-open No. 2003-177612, and is insufficient to provide a reinforcing effect, consequently causing creeping to occur. In order to improve the reinforcing effect, a large quantity of barium sulfate must be added. However, although the addition of such a large quantity of barium sulfate may reduce creeping, it may make the belt highly brittle, so that breaking or chipping occurs when the electrophotographic endless belt is repeatedly flexed.

Now, usually, it is common for the electrical resistance of the electrophotographic endless belt to be controlled by dispersing a conducting agent in a binder resin. For example, a method is available in which an organic antistatic agent or an electrolyte is dispersed in a binder resin. In this method, a surface-active agent or a hydrophilic resin is commonly used as the organic antistatic agent, and a metal salt, such as a lithium salt or a potassium salt, is commonly used as the electrolyte.

However, in the case when the surface-active agent or metal salt is used, while surface resistivity may decrease, it may be difficult to decrease volume resistivity. To control the volume resistivity, a large quantity of the surface-active agent or metal salt must be added, which brings about a problem of this additive leaching out to the surface of the electrophotographic endless belt.

In the case when the hydrophilic resin is used, the electrical resistance cannot be decreased unless a fairly large quantity of it is added to the binder resin. Hence, the electrical resistance of the belt may depend to a large extent on the environmental conditions, which is not desirable.

In addition, where a large quantity of a metal salt having deliquescent properties, such as the lithium salt, is dispersed in the binder resin, there has been a difficulty in that the electrical resistance is greatly affected by moisture.

SUMMARY OF THE INVENTION

An object of the present invention is to solve the above problems to provide an electrophotographic endless belt that may cause neither cracking nor breaking even after repeated use, has superior flexing resistance and also may not cause creeping to occur even in after a long-term service, and to provide an electrophotographic apparatus having such an electrophotographic endless belt.

That is, the present invention is related to an electrophotographic endless belt containing a polyamide resin, carbon black and a filler, characterized in that:

the polyamide resin is at least one resin selected from the group consisting of polyamide 610, polyamide 612, polyamide 11 and polyamide 12;

the filler is at least one filler selected from the group consisting of an oxide, a hydroxide, a carbonate and a silicate; and weight (A) of the polyamide resin and total weight (B) of the carbon black and the filler is in a ratio (A:B) of from 90:10 to 50:50.

The present invention is also an electrophotographic apparatus characterized by having at least the above electrophotographic endless belt.

The present invention is also related to a process for producing the above electrophotographic endless belt, the process being characterized by having:

a resin introduction step of introducing the above polyamide resin into a twin-screw extruder; and a carbon black and filler introduction step of introducing the above carbon black and the above filler into the twin-screw extruder at the time the polyamide resin, having been introduced into the twin-screw extruder through the resin introduction step, has melted.

DETAILED DESCRIPTION OF THE PREFERRED EMBODIMENTS

Figure 1:
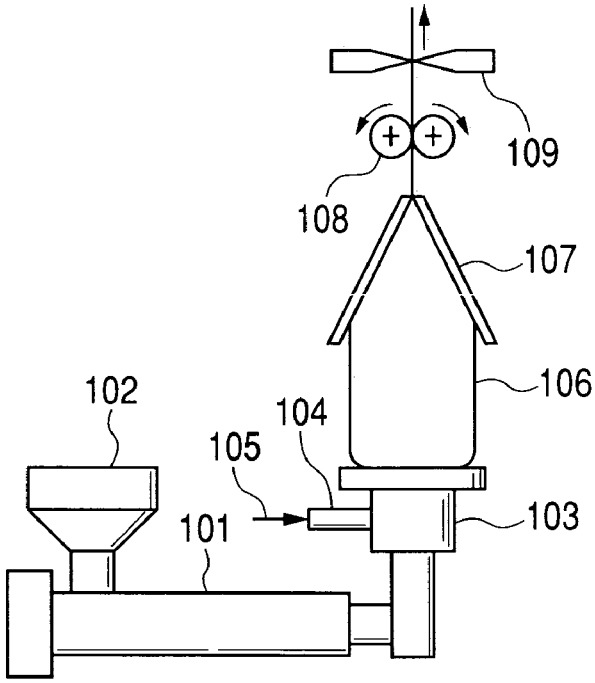
FIG. 1 is a schematic view showing an example of the construction of an apparatus for producing the electrophotographic endless belt, which employs a blown-film extrusion (inflation molding) method.

The electrophotographic endless belt of the present invention contains a polyamide resin, carbon black and a filler.

The polyamide resin refers to a high polymer having as a repeating unit with an amide linkage (-CONH-) in the molecule, and is also called a nylon resin.

The polyamide resin has good flexibility and chemical resistance and also good wear resistance and rub resistance. Hence, it is preferable as a material for the electrophotographic endless belt. Also, because of its flexibility, when the polyamide is used in an intermediate transfer belt or a transfer material transporting belt, soft transfer is possible, and good images can be obtained with fewer hollow characters or spots around line images.

As a result of extensive studies of polyamide resins, the present inventors have found that polyamide 610, polyamide 612, polyamide 11 or polyamide 12, which has a substantially lower water absorption than polyamide 6 or polyamide 66, is preferable as a material for achieving the object of the present invention.

The above four types of polyamide resins have an especially low water absorption among many polyamide resins, have good dimensional stability, and may cause fewer variations of electrical resistance due to environmental changes. They also have lower melting points than other polyamide resins, can be extruded or molded at a relatively low temperature, have a large difference between melt temperature and decomposition temperature, have a broad temperature range in which they can be extruded or molded, and have good extrusion or molding stability. Also, they may require only a small amount of energy to be consumed for heating.

Typically, the modulus of elasticity of polyamide resins tends to increase with an increase in the concentration of amide linkages (-CONH-). However, water absorption tends to increase as well. Polyamide 610, polyamide 612, polyamide 11 and polyamide 12 have low melting points, are flexible and also have a low water absorption insofar as they have long methylene chains. However, on the other hand, they tend to have a low modulus of elasticity.

Polyamide 610 is also called polyhexamethylene sebacamide (nylon 610). Polyamide 12 is also known as polydodecanamide (nylon 12).

Polyamide 610 is obtained by polycondensation of hexamethylene diamine (HMD) and sebasic acid, and polyamide 612 is obtained by polycondensation of hexamethylene diamine (HMD) and dodecanedioic acid. Also, polyamide 11 is obtained by polycondensation of 11-aminoundecanoic acid, and polyamide 12 is obtained by ring-opening polymerization of ω-laurolactam or polycondensation of 12-aminododecanoic acid.

In the present invention, the polyamide resin may preferably be one having a number-average molecular weight in the range of from 5,000 to 50,000.

Polyamide 610, polyamide 612, polyamide 11 and polyamide 12 are commonly available and can be commercially obtained with ease. For example, commercial products that may be used include AMILAN, available from Toray Industries, Inc.; RILSAN, available from Atofina Co.; GRILLAMIDE, available from Ems Showa Denko K.K.; DIAMID, available from Daicel-Degussa Ltd; UBE Nylon, available from Ube Industries, Ltd.; and ZYTEL, available from Du Pont.

In the present invention, the polyamide resin may also include copolymers of polyamide 610, copolymers of polyamide 612, copolymers of polyamide 11 and copolymers of polyamide 12, as well as their polymer alloys and polymer blends.

In accordance with the present invention, each of the above four types of polyamide resins may be used alone or these types may be used in combination of two or more thereof. When two or more types are used in combination, their mixing proportions may be appropriately selected in accordance with the required modulus of elasticity and water absorption. The modulus of elasticity and water absorption depend on the concentration of amide linkages (-CONH-), as described above.

In the present invention, a plurality of polyamide resins selected from polyamide 610, polyamide 612, polyamide 11 and polyamide 12 may also be used. Polyamide 610 and polyamide 612 have a higher water absorption and modulus of elasticity than polyamide 11 and polyamide 12. Accordingly, when a higher modulus of elasticity is required, the content of polyamide 610 or polyamide 612 may be increased, and, conversely, when a lower water absorption is required, the content of polyamide 11 or polyamide 12 may be increased.

Increasing the content of polyamide 610 or polyamide 612 is also advantageous when transfer residual toner on the surface of the electrophotographic endless belt is removed by cleaning (such as electrostatic cleaning or blade cleaning).

Thus, in the case when two or more types of polyamide resins are used, the content of each polyamide resin may appropriately be controlled in accordance with the rating of properties required for the electrophotographic endless belt. In particular, when two types of polyamide resins are used, their preferable mixing ratio is 10:90 to 90:10.

In the present invention, in order to control the electrical resistance of the electrophotographic endless belt, carbon black is used as a conducting agent. Carbon black cannot be affected by temperature and humidity to cause a variation in the electrical resistance as easily as organic antistatic agents or electrolytes. Also, it is not possible for carbon black to leach out to the electrophotographic endless belt surface. Further, it has a reinforcing effect on the binder resin and also can improve creep resistance of the electrophotographic endless belt.

Carbon black used in the present invention may be furnace black, thermal black, gas black, acetylene black and KETJEN BLACK. Carbon black used for coloring may also be sufficient to function as the conducting agent.

The above carbon black is commercially available and can be obtained with ease. For example, commercial products may include, as acetylene black, DENKA BLACK (powdery products, granular products, pressed products, HS-100, etc.), available from Denki Kagaku Kogyo Kabushiki Kaisha; KETJEN BLACK (EC, EC600JD), available from Lion Corporation; COLOR BLACK, SPECIAL BLACK, PRINTEX, HI BLACK and LAMP BLACK, available from Deggusa Corp.; RAVEN, available from Columbian Carbon; VULCAN, MONARCH, REGAL, BLACK PEARLS and MOGUL, available from Cabot Corp.; ASAHI CARBON, available from Asahi Carbon Co., Ltd.; and TOKA BLACK, available from Tokai Carbon Co., Ltd.

If the carbon black content is too high, it is difficult to extrude the material into an endless belt. Depending on the types of carbon black, some materials can be extruded even when there is a large quantity of carbon black. However, where the carbon black content is too high, while the electrophotographic endless belt obtained can have a high modulus of elasticity and have improved creep resistance, it may be highly brittle and have poor flexing resistance. The carbon black content is preferably less than 40% by weight based on the total weight of the electrophotographic endless belt.

If, on the other hand, the carbon black content is too small, the desired electrical resistance of the electrophotographic endless belt may not be attained, or a sufficient reinforcing effect may not be attained, resulting in a low modulus of elasticity or a tendency to creep. Therefore, the carbon black content is preferably 2% by weight or more based on the total weight of the electrophotographic endless belt.

Incidentally, conducting agent(s) other than carbon black may also be added to the electrophotographic endless belt of the present invention.

As a method for adding the carbon black, a master batch method may be used in order to improve dispersibility.

A filler other than carbon black is further added to the electrophotographic endless belt of the present invention. The filler other than carbon black refers to an oxide, a hydroxide, a carbonate or a silicate.

The oxides may include, e.g., silica, diatomaceous earth, alumina, zinc oxide, titanium oxide, calcium oxide, magnesium oxide, iron oxide, tin oxide, antimony oxide, and ferrite.

The hydroxides may include, e.g., calcium hydroxide, magnesium hydroxide and aluminum hydroxide. The hydroxide has not only a reinforcing effect, but also a flame-retarding effect.

The carbonates may include, e.g., calcium carbonate, magnesium carbonate, zinc carbonate, barium carbonate, dawsonite and hydrotalcite.

The silicates may include, e.g., clay, activated clay, sepiolite, imogolite and sericite.

The use of carbon black in combination with the above filler enables formation of well-reproduced images, compared with those formed when the electrical resistance is controlled using only carbon black.

The addition of the above filler to the polyamide resin enhances the modulus of elasticity of the electrophotographic endless belt, and consequently, prevents creeping and allows the belt to be subjected to long-term use.

The addition of the above filler, having a low water absorption, is also effective in lowering the water absorption of the electrophotographic endless belt made from the polyamide resin. As the result, the electrophotographic endless belt is only slightly influenced by the environment, and good images can be obtained in either a low-temperature, low-humidity environment or a high-temperature, high-humidity environment.

The above filler used in the present invention differs from the inorganic filler disclosed in Japanese Patent Application Laid-open No. 2003-177612. The barium sulfate inorganic filler disclosed in Japanese Patent Application Laid-open No. 2003-177612 acts as a dispersing agent for carbon black, whereas the above filler used in the present invention reinforces the electrophotographic endless belt. Barium sulfate has a low reinforcing effect.

The dispersibility of carbon black can be improved by selecting the type of carbon black or a kneading method therefor, or by adding a dispersing agent. This enables the required functional characteristics of the electrophotographic endless belt to be satisfied.

The above filler used in the present invention may preferably have a particle diameter of from 0.01 μm to 5 μm. If it has a particle diameter of less than 0.01 μm, the filler may scatter, making operability poor and making it difficult to effect a uniform dispersion. If it has a particle diameter of more than 5 μm, it may be difficult to provide the effect of reinforcing the electrophotographic endless belt. Also, such a filler may protrude from the electrophotographic endless belt surface.

The particle shape of the filler may include a granular shape (spherical, or amorphous), a platelike shape and a fibrous shape (acicular). The above particle diameter is an average value taken between the maximum diameter and the minimum diameter.

The above filler used in the present invention need not necessarily be conductive and may suffice as long as it contributes to an improvement in the mechanical strength of the electrophotographic endless belt. Of course, a conductive filler may also be used.

In the electrophotographic endless belt of the present invention, the proportion (ratio) of the content of the above polyamide resin to the content of the combination of carbon black and the above filler is as follows (weight ratio): [the above polyamide resin]:[carbon black plus the above filler]=90:10 to 50:50.

It may preferably be as follows: [the above polyamide resin]:[carbon black plus the above filler]=75:25 to 60:40.

Even among those materials that are relatively inactive with respect to the above polyamide resin, like carbon black and the above filler, there is a limit to the quantity in which the above polyamide resin can cover the particle surfaces of carbon black or the above filler. Hence, if the total weight of carbon black and the above filler is too large, the material cannot be extruded into an endless belt. If, on the other hand, the total weight of carbon black and the above filler is too small, the effect of reinforcing the electrophotographic endless belt may not be sufficiently obtained, and the electrophotographic endless belt may creep.

In general, polyamide resins may undergo large changes in melt viscosity with respect to temperature, and, where extrusion or the like is carried out, they have a narrow temperature range in which a stable extrusion of the material can take place. In order to carry out a stable extrusion, it is preferable for the electrophotographic endless belt of the present invention to contain a modified polyolefin.

This modified polyolefin is meant to be a polyolefin (polyethylene, polypropylene) into the molecular chain of which a reactive functional group (e.g., an epoxy group, a maleic anhydride group or an oxazoline group) has been introduced.

Such modified polyolefins may include, e.g., epoxy-group-containing olefin copolymers, an ethylene/glycidyl methacrylate copolymer, a maleic anhydride/ethylene copolymer, an ethylene/vinyl acetate/glycidyl methacrylate terpolymer, an ethylene/ethyl acrylate/glycidyl methacrylate terpolymer, an ethylene/glycidyl acrylate copolymer, an ethylene/vinyl acetate/glycidyl acrylate terpolymer and an ethylene/acrylate/maleic anhydride terpolymer.

Such a modified polyolefin is commonly available and can be commercially obtained with ease. Commercial products may include, e.g., BOND FAST, available from Sumitomo Chemical Co., Ltd.; BONDYNE, available from Sumitomo Atofina Co., Ltd.; REXPEARL, and ADOTEX, available from Nippon Polyethylene Co., Ltd.; MODIPER, available from Nippon Oil & Fats Co., Ltd.; and Umex, available from Sanyo Chemical Industries, Ltd.

The modified polyolefin, particularly modified polyethylene, also has superior non-adhesive properties compared with the polyamide resin. As a result, the toner is less likely to adhere to the surface of the electrophotographic endless belt. Also, the toner scattered inside the electrophotographic apparatus less likely to adhere to the back of the electrophotographic endless belt. Further, the ability to clean the toner adhered to the surface of the electrophotographic endless belt is improved.

In general, the modified polyolefin has a lower modulus of elasticity than the polyamide resin, where the modulus of elasticity of the electrophotographic endless belt tends to decrease with an increase in the amount of the modified polyolefin added to the electrophotographic endless belt. This may induce the electrophotographic endless belt to creep. Accordingly, the amount of the added modified polyolefin may preferably be less than 50% by weight based on the weight of the polyamide resin.

For the purpose of improving various properties, a thermoplastic elastomer may be incorporated into the electrophotographic endless belt of the present invention. The thermoplastic elastomer may be conductive.

The thermoplastic elastomers may include, e.g., polyolefin type, polystyrene type, polyamide type, polyester type, a hydrogenated SBS type and polyurethane type thermoplastic elastomers.

However, the modulus of elasticity of the electrophotographic endless belt also tends to decrease with an increase in the amount of the thermoplastic elastomer added to the electrophotographic endless belt. Again, this may promote creeping of the electrophotographic endless belt. Accordingly, the amount of the added thermoplastic elastomer may preferably be less than 50% by weight based on the weight of the polyamide resin.

With regard to the heat at the time of extrusion in producing the electrophotographic endless belt, a large shear force is applied when carbon black and the above filler are kneaded using a twin-screw extruder. This may cause self-generation of heat to make a part of the polyamide resin undergo a thermal decomposition. Accordingly, the electrophotographic endless belt of the present invention may preferably contain an antioxidant.

The antioxidants may include copper halides (e.g., copper (I) iodide), potassium halides (e.g., potassium iodide), hindered phenol types, phosphorus types and phosphite types. Any of these may be used alone, or may be used in the form of a mixture of two or more types of antioxidants.

The phosphite type antioxidants may include ADEKASTAB PEP-36, available from Asahi Denka Kogyo K.K., and IRGAPHOS, available from Ciba Specialty Chemicals Inc.

The hindered phenol type antioxidants may include IRGANOX 1010 (pentaerythritol tetrakis[3-(3,5-di-tert—butyl-4-hydroxyphenyl) Propionate], IRGANOX 1098, and IRGANOX 245, available from Ciba Specialty Chemicals Inc.

A flame retardant may be added to the electrophotographic endless belt of the present invention.

As the flame retardant, melamine and melamine cyanurate, which are triazine compounds, and phosphorus type flame retardants are preferred, because they have an especially remarkable effect on the polyamide resin.

For the purpose of improving dispersibility of carbon black and the above filler, a dispersing agent may also be incorporated into the electrophotographic endless belt.

The dispersing agents may include polyglycerol polyricinolate and polyglycerol stearate.

The dispersing agent may be used to carry out a dispersion treatment by a known treating method (such as a wet process or a dry process) using a known treating apparatus (such as Henschel mixer or Super mixer).

In addition to the components described above, other component(s) may also be added to the electrophotographic endless belt, as long as the effect of the present invention is not negated. Such other component(s) may include, e.g., a processing aid, a lubricant, a release agent, a plasticizer, a colorant, a nucleating agent and an age resistor.

The process for producing the electrophotographic endless belt may include, e.g., extrusion, blown-film extrusion (inflation), injection molding, and blow molding. In particular, blown-film extrusion is preferred.

FIG. 1 is a schematic view showing an example of the construction of an apparatus for producing the electrophotographic endless belt, which employs blown-film extrusion.

First, an extrusion material prepared by premixing the above polyamide resin, carbon black and filler under the stated formulation, followed by kneading and dispersion, is put into an extruder 101 from a hopper 102. Temperature and screw construction in the extruder 101 are selected so that the extrusion material may have a melt viscosity so that it can be extruded into a belt. Also, the conductive filler is uniformly dispersed in the extrusion material.

The extrusion material is melt-kneaded in the extruder 101 into a melt, which then enters a circular die 103. The circular die 103 is provided with a gas inlet passage 104. Through the gas inlet passage 104, gas 105, such as air, is blown into the circular die 103, whereupon the melt, having passed through the circular die 103, inflates expanding in diameter. The extrusion may be carried out without blowing the gas 105 into the gas inlet passage 104.

The thus inflated extruded product (tubular film 106) is drawn upward by a pinch roller 108 while being cooled by a cooling ring (not shown). When the tubular film 106 is drawn upward, it passes through the space defined by a dimension stabilizing guide 107, whereby the length in the peripheral direction (peripheral length) of the electrophotographic endless belt is fixed. Also, the film is cut with a cutter 109, whereby the length in the generatrix direction (width) of the electrophotographic endless belt is fixed.

Thus, the electrophotographic endless belt can be obtained.

Figure 2:
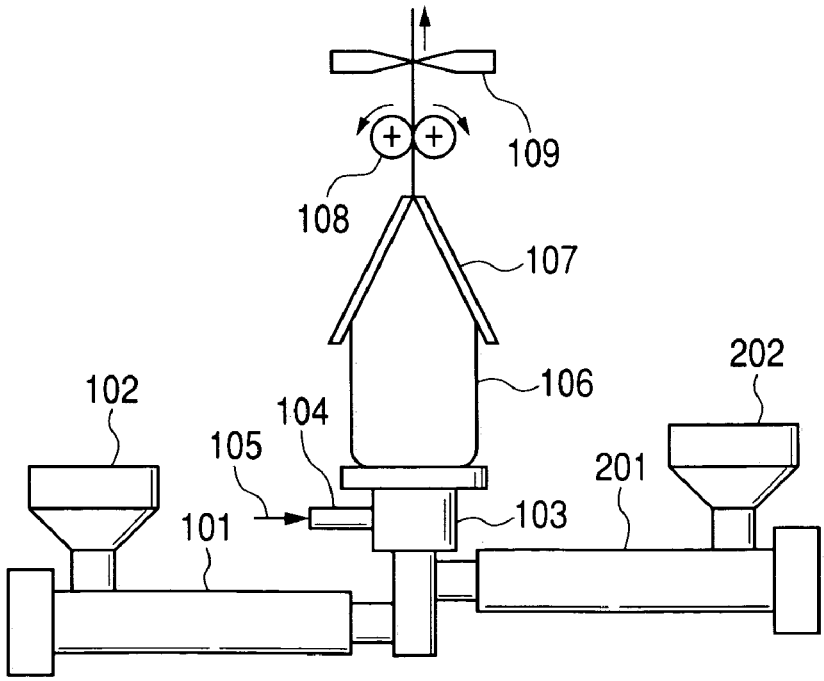
FIG. 2 is a schematic view showing another example of the construction of an apparatus for producing the electrophotographic endless belt, which employs a blown-film extrusion (inflation molding) method.

The foregoing description relates to production of an electrophotographic endless belt of a single-layer structure. In the case of an electrophotographic endless belt of a double-layer structure, a second extruder 201 is additionally provided, as shown in FIG. 2 (202 denotes a second hopper). A melt from the extruder 101 and a melt from the extruder 201 are simultaneously sent into a circular die 103, and the two layers are scale-up inflated simultaneously. Thus, a two-layer electrophotographic endless belt can be obtained. In the case of a three or more layer construction, extruders may be provided corresponding in number to the number of layers.

As a method of removing folds of the endless belt, which were formed in the process of blown-film extrusion, or making the endless belt surface smooth, a method is available, which makes use of a set of cylindrical forms made of materials having different coefficients of thermal expansion and having different diameters.

Specifically, a small-diameter cylindrical form (inner form) has a coefficient of thermal expansion larger than the coefficient of thermal expansion of a large-diameter cylindrical form (outer form). The tubular film (endless belt) obtained by extrusion is placed over this inner form. Thereafter, the inner form with the film is inserted into the outer form so that the tubular film (endless belt) is held between the inner form and the outer form. A gap between the inner form and the outer form may be determined by a calculation based on heating temperature, difference in the coefficient of thermal expansion between the inner form and the outer form and the pressure required.

A form in which the inner form, the endless belt and the outer form have been set, in order from the inside, is heated to the vicinity of the softening point temperature of the polyamide resin used in the endless belt. As a result of the heating, the inner form, having a larger coefficient of thermal expansion, acts so as to expand more than the inner diameter of the outer form. Hence, a uniform pressure is applied to the whole endless belt. Here, the surface of the endless belt having reached the vicinity of its softening point, is pressed against the inner surface of the outer form, so that the folds can be removed. Thereafter, these are cooled, and then the endless belt is removed from the forms. Thus, an endless belt from which the folds have been removed can be obtained. This method simultaneously enables dimensional control and modification of surface properties. Also, a plurality of superimposed endless belts may be placed over the inner form, whereby a multi-layer endless belt is obtainable.

The electrophotographic endless belt of the present invention may or may not have a joint. That is, the material may be extruded in the shape of a sheet, and thereafter, the sheet may be rolled up and then joined by ultrasonic welding or the like. Also, the inner form and outer form as described above may be used to obtain the endless belt.

The electrophotographic endless belt of the present invention may preferably have a thickness of from 50 μm to 250 μm. If the electrophotographic endless belt is too thick, it may have a low belt travel performance, because of high rigidity and poor flexibility, causing a deflection or one-sided travel. If, on the other hand, the electrophotographic endless belt is too thin, it may have low tensile strength or may cause creeping as a result of long-term use.

Before the above blown-film extrusion is carried out, the extrusion material is obtained by premixing the above polyamide resin, carbon black and filler under the stated formulation, followed by kneading and dispersion. As a method therefor, a method is preferred in which these are kneaded by means of a twin-screw extruder to obtain the extrusion material.

Figure 3:
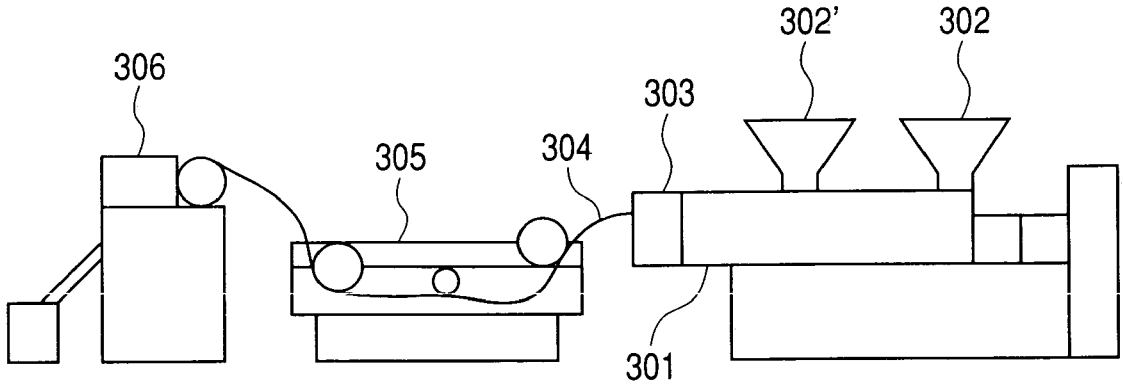
FIG. 3 is a schematic view showing an example of the construction of an extruder.

FIG. 3 schematically illustrates an example of the construction of the twin-screw extruder.

It is common that components constituting the extrusion material are introduced at one time from a hopper 302 into a twin-screw extruder 301. However, the electrophotographic endless belt is required to have a higher precision than commonly available resin extruded products. Also, the dispersibility of carbon black and the filler must be more improved. Hence, a method is preferred in which the polyamide resin is first introduced into the twin-screw extruder 301, and then, at the stage where the polyamide resin has melted, carbon black and the filler are introduced into the twin-screw extruder 301 (side feed, i.e., halfway introduction). In FIG. 3, reference numeral 302' also denotes a hopper.

Materials melt-kneaded by the twin-screw extruder are extruded from a strand die 303 in the form of a strand 304, which is then passed through a water bath 305 so as to be cooled, and then passed through a strand cutter 306 to obtain the extrusion material.

The kneading in the twin-screw extruder may be one-time kneading, or what has first been passed through the twin-screw extruder may be kneaded two or more times by means of the twin-screw extruder (two or more time kneading).

The twin-screw extruder may be, e.g., TEX, manufactured by The Japan Steel Works, Ltd. (JSW); TEM, manufactured by Toshiba Machine Co., Ltd.; and PCM, manufactured by Ikegai Corp.

In the blown-film extrusion (inflation molding) described above, the extrusion material is obtained beforehand and then extruded in the shape of an endless belt. However, the extrusion material may be extruded in the shape of an endless belt in one step.

The electrophotographic endless belt of the present invention may preferably have a volume resistivity of from $1\times10^{6}$ to $1\times10^{14}$ Ωcm. If the volume resistivity of the electrophotographic endless belt is too low, it may be difficult to attract and hold a transfer material when, e.g., this belt is used as a transfer material transporting belt. If, on the other hand, the volume resistivity of the electrophotographic endless belt is too high, electric charges may tend to accumulate in the electrophotographic endless belt to make it difficult to perform charge elimination. Also, it is necessary to increase the transfer voltage, which require a large-size power source or lead to an increase in cost.

A method of measuring the volume resistivity of the electrophotographic endless belt in the present invention is described below.

Measuring Machine

Resistance meter: Ultra-high resistance meter R8340A (manufactured by Advantest Corporation).

Sample box: Sample box TR42 for ultra-high resistance meter (manufactured by Advantest Corporation).

The main electrode is 25 mm in diameter, and the guard-ring electrode is 41 mm in inner diameter and 49 mm in outer diameter.

Sample

The electrophotographic endless belt is cut in a circular form that is 56 mm in diameter. After cutting, it is provided, on its one side, with an electrode over the whole surface by forming a Pt-Pd deposited film and, on the other side, provided with a main electrode that is 25 mm in diameter and a guard electrode that is 38 mm in inner diameter and 50 mm in outer diameter by forming Pt-Pd deposited films. The Pt-Pd deposited films are formed by carrying out a vacuum deposition for 2 minutes using Mild Sputter E1030 (manufactured by Hitachi Ltd.). The belt on which the vacuum deposition has been carried out is used as the sample.

Measurement Conditions

Measurement atmosphere: 23° C./55% RH(N/N)

Here, the measuring sample is kept in an environment of 23° C./55%RH for 12 hours or more. Measurement mode: Discharge for 10 seconds, and charge and measurement for 30 seconds.

Applied voltage: 100 V.

100 V is used as the applied voltage, which is in the 1 to 1,000 V range of the voltage applied to the electrophotographic endless belt in the electrophotographic apparatus.

The electrophotographic endless belt of the present invention may have a single layer, or may have a multi-layer structure.

The electrophotographic endless belt in the electrophotographic apparatus is usually stretched over a plurality of stretch-over rollers during its use. Here, if it is difficult to prevent the electrophotographic endless belt from meandering, because of straightness, shake or the like of the stretch-over rollers, the electrophotographic endless belt may be provided with a meandering preventive member (a rib or the like).

The polyamide resin used in the present invention may be evaluated or observed by conventionally known methods. For example, to distinguish the types of polyamide resins, a measurement of melting points by DSC (differential scanning calorimetry) may be employed. As a measuring instrument for the DSC, any known instrument may be used. For example, where polyamide 610 and polyamide 12 are used in the form of a mixture, peaks that accompany melting are observed at two spots in the vicinity of 215° C., which is the melting point of polyamide 610, and in the vicinity of 176° C., which is the melting point of polyamide 12. Also, their mixing ratio can be judged from the differences in intensity of the respective peaks (differences in peak area and latent heat of fusion).

Figure 4:
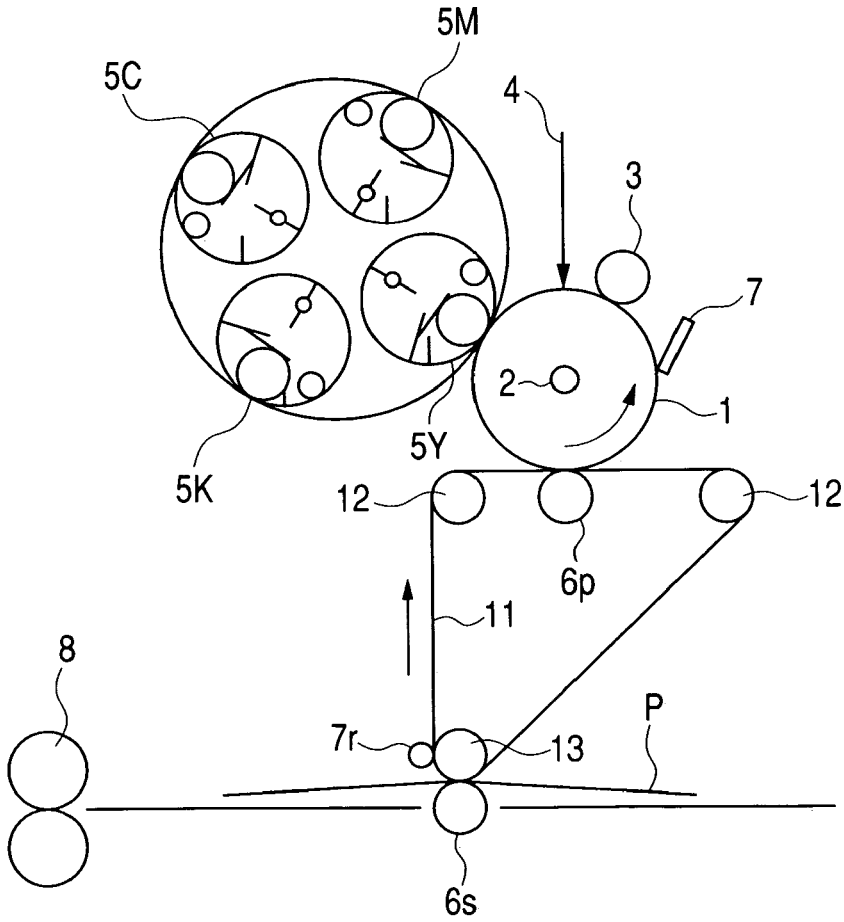
FIG. 4 is a schematic view showing an example of the construction of an intermediate transfer type color electrophotographic apparatus.

FIG. 4 schematically illustrates an example of the construction of a color electrophotographic apparatus of an intermediate transfer system. The transfer of toner images from an electrophotographic photosensitive member to a transfer material is chiefly performed by a primary transfer charging member, an intermediate transfer belt and a secondary transfer charging member.

In FIG. 4, reference numeral 1 denotes a cylindrical electrophotographic photosensitive member, which is rotatingly driven around an axis 2 in the direction of an arrow at a prescribed peripheral speed.

The electrophotographic photosensitive member 1 is uniformly electrostatically charged on its surface to have positive or negative stated potential through a primary charging member 3. The photosensitive member thus charged is then exposed to an exposure light (image-wise exposure light) 4 emitted from an exposure means (not shown) for slit exposure or laser beam scanning exposure. The exposure light used here corresponds to a first-color-component image (e.g., a yellow-component image) of an intended color image. Thus, on the surface of the electrophotographic photosensitive member 1, first-color-component electrostatic latent images (yellow-color-component electrostatic latent image) are successively formed, which correspond to the first-color-component image of the intended color image.

An intermediate transfer belt 11 stretched over stretch-over rollers 12 and a secondary-transfer opposing roller 13 is rotatingly driven in the direction of an arrow at substantially the same peripheral speed as the electrophotographic photosensitive member 1 (e.g., at a speed of 97 to 103% with respect to the peripheral speed of the electrophotographic photosensitive member 1).

The first-color-component electrostatic latent images formed on the surface of the electrophotographic photosensitive member 1 are developed with a first-color toner (yellow toner) contained in a developer held by a first-color developer carrying member (yellow developer carrying member) 5Y, to form a first-color toner image (yellow toner image). Then, the first-color toner images formed and held on the surface of the electrophotographic photosensitive member 1 are successively transferred onto the surface of the intermediate transfer belt 11 passing between the electrophotographic photosensitive member 1 and a primary-transfer charging member (primary-transfer charging roller) 6*p*, by the aid of a primary-transfer bias applied from the primary-transfer charging member 6*p*.

The surface of the electrophotographic photosensitive member 1, from which the first-color toner images have been transferred, is cleaned by a cleaning member 7 to remove primary-transfer residual developer (toner). Thereafter, the cleaned photosensitive member is used for the next-color image formation.

Second-color toner images (magenta toner images), third-color toner images (cyan toner images) and fourth-color toner images (black toner images) are transferred to the surface of the electrophotographic photosensitive member 1, and then, sequentially transferred to the surface of the intermediate transfer belt 11 in the same manner as the first-color toner images. Thus, synthesized toner images corresponding to the intended color image are formed on the surface of the intermediate transfer belt 11. In the course of the first-color to the fourth-color primary transfer, a secondary-transfer charging member (secondary-transfer charging roller) 6*s* and a charge-providing member (charge-providing roller) 7*r* stand separate from the surface of the intermediate transfer belt 11.

The synthesized toner images formed on the surface of the intermediate transfer belt 11 are successively transferred onto a transfer material (such as paper) P by the aid of a secondary-transfer bias applied from the secondary-transfer charging member 6*s*. The transfer material P is taken out and fed from a transfer material feeding means (not shown) to the part (contact zone) between the secondary-transfer opposing roller 13/intermediate transfer belt 11 and the secondary-transfer member 6*s* in the manner synchronized with the rotation of the intermediate transfer belt 11.

The transfer material P to which the synthesized toner images have been transferred is separated from the surface of the intermediate transfer belt 11 and guided into a fixing means 8, where the synthesized toner images are fixed, and is then output from the apparatus as color image-formed matter (a print or a copy).

The charge-providing member 7*r* is brought into contact with the surface of the intermediate transfer belt 11 from which the synthesized toner images have been transferred. The charge-providing member 7*r* provides the secondary-transfer residual developers (toners) held on the surface of the intermediate transfer belt 11 with electric charges having a polarity reverse to that at the time of a primary transfer. The secondary-transfer residual developers (toners) provided with electric charges with the polarity reverse to that at the time of the primary transfer are electrostatically transferred to the surface of the electrophotographic photosensitive member 1 at the contact zone between the electrophotographic photosensitive member 1 and the intermediate transfer belt 11 and the vicinity thereof. Thus, the surface of the intermediate transfer belt 11, from which the synthesized toner images have been transferred, is cleaned by the removal of the transfer residual developers (toners). The secondary-transfer residual developers (toners) remaining after the transfer to the surface of the electrophotographic photosensitive member 1, are removed by the cleaning member 7 together with the primary-transfer residual developers (toners) held on the surface of the electrophotographic photosensitive member 1. The transfer of the secondary-transfer residual developers (toners) from the intermediate transfer belt 11 to the electrophotographic photosensitive member 1 can be performed simultaneously with the primary transfer, and hence the though-put does not decrease.

The surface of the electrophotographic photosensitive member 1, from which the transfer residual developers (toners) have been removed by the cleaning member 7, may also be subjected to charge elimination by pre-exposure light emitted from a pre-exposure means. However, where, as shown in FIG. 4, contact charging making use of a roller-shaped primary charging member (a primary charging roller) or the like is employed in the charging of the surface of the electrophotographic photosensitive member, the pre-exposure is not necessarily required.

Figure 5:
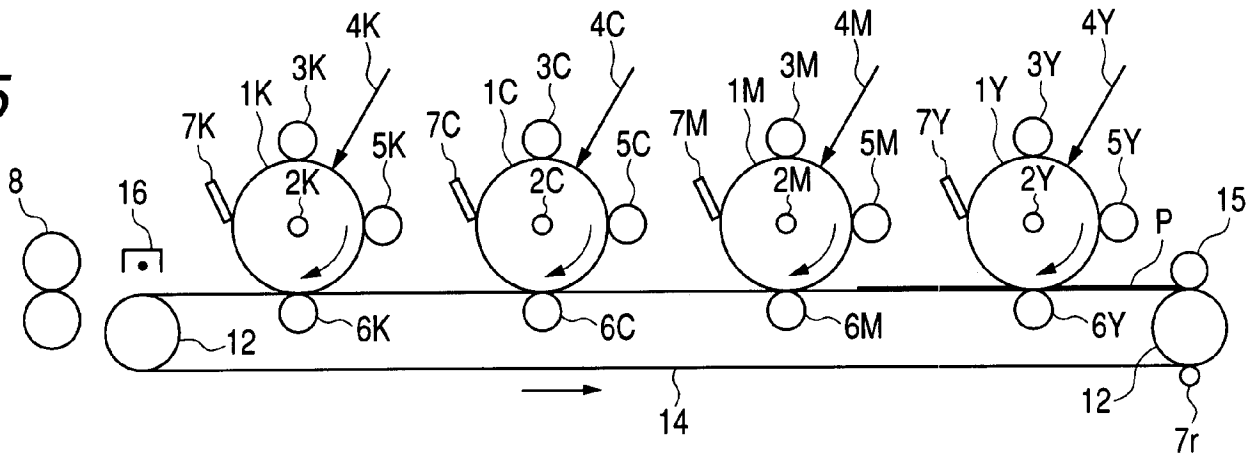
FIG. 5 is a schematic view showing an example of the construction of an in-line type color electrophotographic apparatus.

FIG. 5 schematically illustrates an example of the construction of a color electrophotographic apparatus of an in-line system. The transfer of toner images from an electrophotographic photosensitive member to a transfer material is chiefly performed by a transfer material transport member and a transfer charging member.

In FIG. 5, reference numerals 1Y, 1M, 1C and 1K denote cylindrical electrophotographic photosensitive members (electrophotographic photosensitive members for first color to fourth color), which are rotatingly driven around axes 2Y, 2M, 2C and 2K, respectively, in the directions of arrows, each at a stated peripheral speed.

The surface of the electrophotographic photosensitive member 1Y for the first color, which is rotatingly driven, is uniformly electrostatically charged to a positive or negative given potential through a primary charging member for the first color. The electrophotographic photosensitive member thus charged is then exposed to an exposure light (image-wise exposure light) 4Y emitted from an exposure means (not shown) for slit exposure, laser beam scanning exposure or the like. The exposure light 4Y corresponds to a first-color component image (e.g., a yellow component image) of an intended color image. In this way, first-color component electrostatic latent images (yellow component electrostatic latent images) corresponding to the first-color component image of the intended color image are successively formed on the surface of the electrophotographic photosensitive member 1Y.

A transfer material transport belt 14 stretched by stretch-over rollers 12 is rotatingly driven in the direction of an arrow at substantially the same peripheral speed as the electrophotographic photosensitive members 1Y, 1M, 1C and 1K for the first color to the fourth color (e.g., 97% to 103% with respect to the peripheral speed of each of the electrophotographic photosensitive members 1Y, 1M, 1C and 1K for first color to fourth color). Also, a transfer material (such as paper) P fed from a transfer material feed means (not shown) is electrostatically held on (attracted to) the transfer material transport belt 14, and is successively transported to the parts (contact zones) between the electrophotographic photosensitive members 1Y, 1M, 1C and 1K for the first color to the fourth color and the transfer material transport belt.

The first-color component electrostatic latent images thus formed on the surface of the electrophotographic photosensitive member 1Y for the first color are developed with a first-color toner contained in a developer held on a developer carrying member 5Y for the first color to form first-color toner images (yellow toner images). Then, the first-color toner images thus formed and held on the surface of the electrophotographic photosensitive member 1Y for the first color are successively transferred by the aid of a transfer bias applied from a transfer charging member 6Y for the first color (transfer charging roller for first color) onto a transfer material P held on the transfer material transport belt 14, which passes between the electrophotographic photosensitive member 1Y for the first color and the transfer member 6Y for the first color.

The transfer residual developer (toner) is removed from the surface of the electrophotographic photosensitive member 1Y for the first color, from which the first-color toner images have been transferred, using a cleaning member 7Y for the first color (cleaning blade for first color). Thus, the surface is cleaned. Thereafter, the electrophotographic photosensitive member 1Y for the first color is repeatedly used for the formation of the first-color toner images.

The electrophotographic photosensitive member 1Y for the first color, the primary charging member 3Y for the first color, the exposure means for the first color, the developer carrying member 5Y for the first color and the transfer charging member 6Y for the first color are collectively called an image forming section for the first color.

An image forming section for the second color, which has an electrophotographic photosensitive member 1M for the second color, a primary charging member 3M for the second color, an exposure means for the second color, a developer carrying member 5M for the second color and a transfer charging member 6M for the second color, an image forming section for the third color, which has an electrophotographic photosensitive member 1C for the third color, a primary charging member 3C for the third color, an exposure means for third color, a developer carrying member 5C for the third color and a transfer charging member 6C for the third color, and an image forming section for the fourth color, which has an electrophotographic photosensitive member 1K for the fourth color, a primary charging member 3K for the fourth color, an exposure means for the fourth color, a developer carrying member 5K for the fourth color and a transfer charging member 6K for the fourth color are operated in the same way as the image forming section for the first color. Thus, second-color toner images (magenta toner images), third-color toner images (cyan toner images) and fourth-color toner images (black toner images) are transferred, in order, to the transfer material P, which is held on the transfer material transport belt 14 and to which the first-color toner images have been transferred. In this way, synthesized toner images corresponding to the intended color image are formed on the transfer material P held on the transfer material transport belt 14.

The transfer material P, on which the synthesized toner images have been formed, is separated from the surface of the transfer material transport belt 14, guided into a fixing means 8, where the toner images are fixed, and then output from the apparatus as a color-image-formed material (a print or a copy).

The surfaces of the electrophotographic photosensitive members 1Y, 1M, 1C and 1K for the first color to the fourth color, from which the transfer residual developers (toners) have been removed by the cleaning members 7Y, 7M, 7C and 7K, respectively, may also be subjected to charge elimination by pre-exposure light emitted from pre-exposure means. However, where, as shown in FIG. 5, contact charging using a roller-shaped primary charging member (a primary charging roller) or the like is employed in the charging of the surface of each electrophotographic photosensitive member, the pre-exposure is not necessarily required.

In FIG. 5, reference numeral 15 denotes an attraction roller for attracting the transfer material to the transfer material transport belt. Reference numeral 16 denotes a separation charging assembly for separating the transfer material from the transfer material transport belt.

Figure 6:
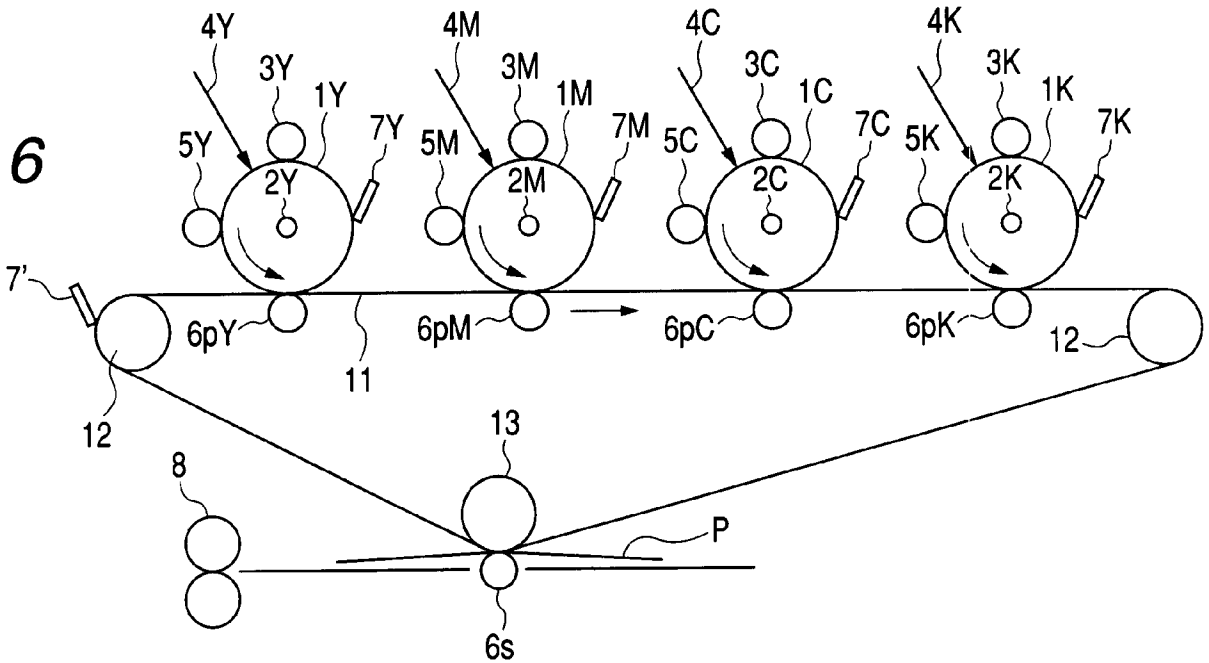
FIG. 6 is a schematic view showing another example of the construction of the intermediate transfer type color electrophotographic apparatus.

FIG. 6 schematically illustrates another example of the construction of a color electrophotographic apparatus of an intermediate transfer system. In the case of the intermediate transfer system, the transfer of toner images from an electrophotographic photosensitive member to a transfer material is chiefly performed by a primary transfer charging member, an intermediate transfer belt and a secondary transfer charging member.

In FIG. 6, reference numerals 1Y, 1M, 1C and 1K denote cylindrical electrophotographic photosensitive members (electrophotographic photosensitive members for the first color to the fourth color), which are rotatingly driven around axes 2Y, 2M, 2C and 2K, respectively, in the directions of arrows, each at a stated peripheral speed.

The surface of the electrophotographic photosensitive member 1Y for the first color, which is rotatingly driven, is uniformly electrostatically charged to a positive or negative given potential through a primary charging member 3*r* for the first color. The electrophotographic photosensitive member thus charged is then exposed to an exposure light (image-wise exposure light) 4Y emitted from an exposure means (not shown) for slit exposure, laser beam scanning exposure or the like. The exposure light 4Y corresponds to a first-color component image (e.g., a yellow component image) of an intended color image. In this way, first-color component electrostatic latent images (yellow component electrostatic latent images) corresponding to the first-color component image of the intended color image are successively formed on the surface of the electrophotographic photosensitive member 1Y.

An intermediate transfer belt 11 stretched over stretch-over rollers 12 and a secondary-transfer opposing roller 13 is rotatingly driven in the direction of an arrow at substantially the same peripheral speed as the electrophotographic photosensitive members 1Y, 1M, 1C and 1K for first color to the fourth color (e.g., 97% to 103% with respect to the peripheral speed of each of the electrophotographic photosensitive members 1Y, 1M, 1C and 1K for the first color to the fourth color).

The first-color component electrostatic latent images thus formed on the surface of the electrophotographic photosensitive member 1Y for first color are developed with a first-color toner contained in a developer held on a developer carrying member 5Y for the first color to form first-color toner images (yellow toner images). Then, the first-color toner images thus formed and held on the surface of the electrophotographic photosensitive member 1Y for the first color are successively primarily transferred by the aid of a primary transfer bias applied from a primary transfer charging member 6*p*Y for the first color (primary transfer charging roller for the first color), which are transferred on to the surface of an intermediate transfer belt 11, which passes the part between the electrophotographic photosensitive member 1Y for the first color and the primary transfer member 6*p*Y for the first color.

The transfer residual developer is removed from the surface of the electrophotographic photosensitive member 1Y for the first color from which the first-color toner images have been transferred (toner) using a cleaning member 7Y for the first color (cleaning blade for first color). Thus, the surface is cleaned. Thereafter, the electrophotographic photosensitive member 1Y for the first color is repeatedly used for the formation of the first-color toner images.

The electrophotographic photosensitive member 1Y for the first color, the primary charging member 3Y for the first color, the exposure means for the first color, the developer carrying member 5Y for the first color and the transfer charging member 6pY for the first color are collectively called an image forming section for the first color.

An image forming section for the second color, which has an electrophotographic photosensitive member 1M for the second color, a primary charging member 3M for the second color, an exposure means for the second color, a developer carrying member 5M for the second color and a primary transfer charging member 6*p*M for the second color, an image forming section for the third color, which has an electrophotographic photosensitive member 1C for the third color, a primary charging member 3C for the third color, an exposure means for the third color, a developer carrying member 5C for the third color and a primary transfer charging member 6*p*C for the third color, and an image forming section for the fourth color, which has an electrophotographic photosensitive member 1K for the fourth color, a primary charging member 3K for the fourth color, an exposure means for the fourth color, a developer carrying member 5K for the fourth color and a primary transfer charging member 6*p*K for the fourth color are operated in the same way as the image forming section for the first color. Thus, second-color toner images (magenta toner images), third-color toner images (cyan toner images) and fourth-color toner images (black toner images) are transferred, in order, to the surface of the intermediate transfer belt 11. In this way, synthesized toner images corresponding to the intended color image are formed on the surface of the intermediate transfer belt 11.

The synthesized toner images formed on the surface of the intermediate transfer belt 11 are successively transferred onto a transfer material (such as paper) P by the aid of a secondary-transfer bias applied from a secondary-transfer charging member 6*s*. The transfer material P is taken out and fed from a transfer material feeding means (not shown) to the part (contact zone) between the secondary-transfer opposing roller 13/intermediate transfer belt 11 and the secondary-transfer charging member 6*s* in the manner synchronized with the rotation of the intermediate transfer belt 11.

The transfer material P to which the synthesized toner images have been transferred is separated from the surface of the intermediate transfer belt 11, guided into a fixing means 8, where the toner images are fixed, and then output from the apparatus as a color-image-formed material (a print or a copy).

The secondary-transfer residual developers (toners) are removed from the surface of the intermediate transfer belt 11, from which the synthesized toner images have been transferred, using an intermediate transfer belt cleaning member 7'. Thus, its surface is cleaned. Thereafter, it is repeatedly used for the formation of the synthesized toner images.

The surfaces of the electrophotographic photosensitive members 1Y, 1M, 1C and 1K for the first color to the fourth color, from which the transfer residual developers (toners) have been removed by the cleaning members 7Y, 7M, 7C and 7K for the first color to the fourth color, respectively, may also be subjected to charge elimination by pre-exposure light emitted from pre-exposure means. However, where, as shown in FIG. 6, contact charging using a roller-shaped primary charging member (a primary charging roller) or the like is employed in the charging of the surface of each electrophotographic photosensitive member, the pre-exposure is not necessarily required.

The electrophotographic endless belt of the present invention may preferably be used in the above intermediate transfer belt and transfer material transporting belt.

In the foregoing, with regard to the electrophotographic endless belt of the present invention, it has chiefly been described based on a case in which it is used as the intermediate transfer belt or the transfer material transporting belt. However, besides the intermediate transfer belt or the transfer material transporting belt, the electrophotographic endless belt of the present invention is applicable to the entire field of endless belts used in electrophotographic apparatuses, such as a photosensitive belt, a transfer belt, transporting belts other than the transfer material transporting belt, a fixing belt, a developing belt, a charging belt and a paper feed belt.

The electrophotographic endless belt of the present invention may also be set in the main body of the electrophotographic apparatus as it is, or may be used as an endless belt cartridge in the form that it is detachably mountable on the main body of the electrophotographic apparatus. For example, a process cartridge may be set up in which the electrophotographic endless belt of the present invention and electrophotographic process members, such as the electrophotographic photosensitive member and the primary charging member, are integrally set.

The present invention is described below in greater details by specific working examples. It should be noted that the present invention is by no means limited to these examples. In the following Examples, "part(s)" refers to "part(s) by weight".

The evaluations of flexing resistance, creep resistance and resistance change due to the environment were made in the following manner.

Evaluation of Flexing Resistance

Figure 7:
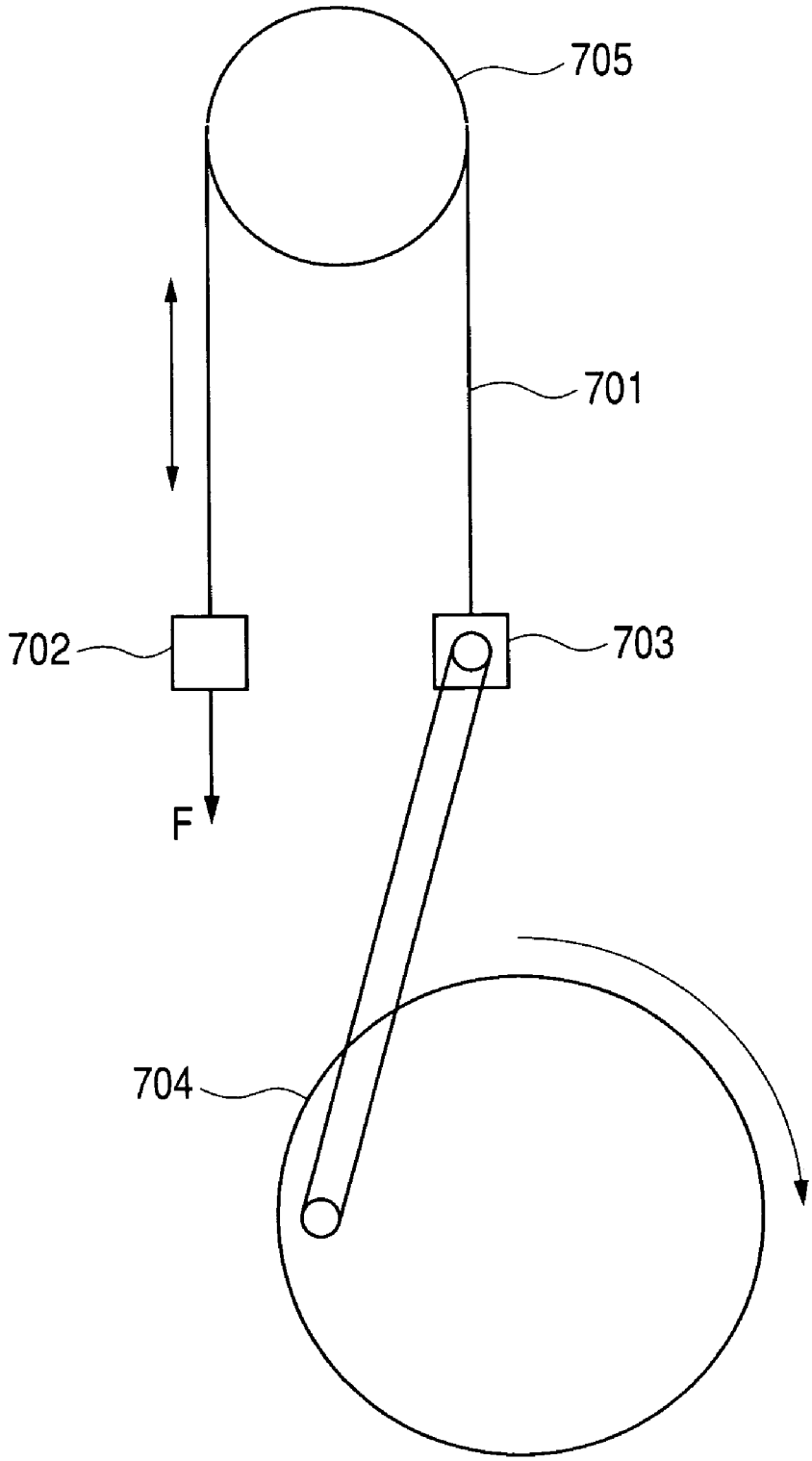
FIG. 7 is a schematic view showing the construction of a flexing tester.

The flexing resistance is evaluated using a flexing tester set up as shown in FIG. 7

Where the electrophotographic endless belt has a thickness of 100 μm, the electrophotographic endless belt is cut in a strip that is 20 mm wide and 200 mm long. This strip-shaped sample 701 is set on chucks 702 and 703 of the flexing tester. The chuck 703 is connected to the crank 704 side, and a load (F) of 1 kg is applied to the chuck 702. Driving the crank 704 (rotating a disk in the direction of an arrow) makes the strip-shaped sample 701 move reciprocally over a roller (free rotatable) 705 to make it bend and stretch repeatedly.

Through this test, the sample can be subjected to a stress that is greater than that to which the electrophotographic endless belt is actually subjected in the electrophotographic apparatus.

The roller 705 is 10 mm in diameter, 20 mm in movement stroke, and movable at a speed of 0.5 second per one reciprocation.

The load per unit sectional area of the strip-shaped sample 701 must be uniform in every sample. Hence, where, e.g., the electrophotographic endless belt has a thickness of 200 μm, the strip-shaped sample is prepared in a width of 10 mm.

In conducting this test, a sample that neither broke nor cracked even after 1,000,000 reciprocations is judged to have flexing resistance.

Evaluation of Creep Resistance

In evaluating the above flexing resistance, the distance (L0) between the two chucks before the evaluation is measured, and the distance (L1) between the two chucks after 1,000,000-time reciprocation is measured. The evaluation is carried out using a creep rate:

Creep rate (%)=(L1−L0)/L0×100.

In conducting this test, a sample having a creep rate of less than 4% is judged to have creep resistance.

Resistance Change Due to Environment

This resistance is evaluated by the logarithm of a difference (environmental resistance difference) between volume resistivity (RvL) measured in an environment of 15° C./10%RH (L/L) and volume resistivity (RvH) measured in an environment of 30° C./80%RH (H/H). A sample having this value that is less than two figures is judged to undergo a smaller resistance change due to the environment.

EXAMPLE 1

An electrophotographic endless belt was produced using the following materials.

| | |
|---|---|
| Polyamide 610 | 40 parts |
| Polyamide 12 | 30 parts |
| Carbon black (DENKA BLACK powdery product) | 12 parts |
| Zinc oxide | 13.76 parts |
| Modified polyolefin | 4 parts |
| Dispersing agent | 0.12 part |
| Antioxidant | 0.12 part |

Polyamide 610, polyamide 12, the modified polyolefin and the antioxidant were mixed by means of a tumbling mixer. Also, separately, carbon black and the dispersing agent were mixed by means of a Henschel mixer.

Next, in the apparatus set up as shown in FIG. 3, polyamide 610, polyamide 12, the modified polyolefin and the antioxidant, having been mixed beforehand, were introduced into the twin-screw extruder 301 from the hopper 302. At the stage the resin melted, zinc oxide and carbon black and dispersing agent, having been mixed beforehand, were introduced into the twin-screw extruder 301 from the hopper 302'.

The above materials, which have been melt-kneaded (kneading temperature: 260° C.) by means of the twin-screw extruder 301, were extruded from the strand die 303 in the form of the strand 304, which was then passed through the water bath 305 to be cooled, and then passed through the strand cutter 306 to obtain an extrusion material.

Next, in the apparatus set up as shown in FIG. 1, the extrusion material was introduced into the installed hopper 102 to the extruder 101, and the blown-film extrusion (inflation molding) described previously was carried out to obtain an endless belt.

Next, using a set of cylindrical forms made of materials having different coefficients of thermal expansion and having different diameters, folds of the endless belt obtained were removed, surface smoothness thereof was adjusted and size thereof was adjusted in the manner described above. Here, the heating of the form in which the inner form, the endless belt and the outer form were set, in order from the inside, was carried out at 200° C. for 20 minutes.

Next, both edges of the endless belt whose folds were removed, surface smoothness was adjusted and size was adjusted were precisely cut to obtain an electrophotographic endless belt of 480 mm in peripheral length, 250 mm in width and 100 μm in thickness. A meandering preventive member was also attached to the back of this electrophotographic endless belt.

The flexing resistance and creep resistance of the electrophotographic endless belt obtained were evaluated. As a result of the evaluation, the belt was seen to have good flexing resistance and creep resistance.

The electrophotographic endless belt obtained was also set as a transfer material transporting belt in the electrophotographic apparatus (color laser printer) set up as shown in FIG. 5, and reproduction of full-color images was tested in each environment of N/N, L/L and H/H to evaluate images at the initial stage. As a result of the evaluation, good images were seen to have been obtained. These images were free of faults, such as color aberration, and, in particular, free of spots around line images or hollow characters, which is due to the addition of the modified polyolefin.

Thereafter, in each environment, a running test of image reproduction was conducted on 10,000 sheets. After the running test was finished, the electrophotographic endless belt (transfer material transporting belt) was observed. As a result, no problems, such as cracking, breaking or tearing, were observed. Moreover, no creeping that might adversely affect the operation of the electrophotographic apparatus or the quality of reproduced images was observed.

The results of evaluation are shown in Table 1.

EXAMPLES 2 TO 5

Electrophotographic endless belts (transfer material transporting belts) were produced in the same manner as in Example 1, except that the materials used therein were changed as shown in Table 1. The evaluation was made in the same manner. The results of the evaluation are shown in Table 1.

EXAMPLE 6

An electrophotographic endless belt was produced in the same manner as in Example 1, except that the materials used therein were changed as shown in Table 1, and that the electrophotographic endless belt was formed in a size of 440 mm in peripheral length, 240 mm in width and 100 μm in thickness.

The electrophotographic endless belt obtained was set as a transfer material transporting belt in the electrophotographic apparatus (color laser printer) set up as shown in FIG. 5, and the same items as those in Example 1 were evaluated. The results of the evaluation are shown in Table 1.

EXAMPLES 7

An electrophotographic endless belt was produced in the same manner as in Example 1, except that the materials used therein were changed as shown in Table 1, and that the electrophotographic endless belt was formed in a size of 700 mm in peripheral length, 260 mm in width and 100 μm in thickness.

The electrophotographic endless belt obtained was set as an intermediate transfer belt in the electrophotographic apparatus (color laser printer) set up as shown in FIG. 6, and the same items as those in Example 1 were evaluated. The results of the evaluation are shown in Table 1.

COMPARATIVE EXAMPLES 1 TO 9

Electrophotographic endless belts (transfer material transporting belts) were produced in the same manner as in Example 1, except that the materials used therein were changed as shown in Table 1, and that the kneading temperature was set to 270° C. in Comparative Example 1, 300° C. in Comparative Example 2, 330° C. in Comparative Example 3, and 280° C. in Comparative Example 4. The evaluation was made in the same manner. In Comparative Example 8, the electrophotographic endless belt broke in the flexing test. Hence, creep resistance could not be evaluated. The results of the evaluation are shown in Table 2.

TABLE 1

| Materials | Example | | | | | | |
|---|---|---|---|---|---|---|---|
| [part(s)] | 1 | 2 | 3 | 4 | 5 | 6 | 7 |
| Polyamide resin: | | | | | | | |
| PA610 | 40 | — | 37 | 67 | — | — | — |
| PA612 | — | — | — | — | — | 60 | — |
| PA11 | — | — | — | — | — | — | 67 |
| PA12 | 30 | 74 | 37 | — | 67 | — | — |
| PA6 | — | — | — | — | — | — | — |
| PA66 | — | — | — | — | — | — | — |
| PA46 | — | — | — | — | — | — | — |
| MXD6 | — | — | — | — | — | — | — |
| Carbon black: | | | | | | | |
| DENKA | 12 | 13 | 12 | 12 | 13 | — | — |
| EC600JD | — | — | — | — | — | — | 3.3 |
| REGAL 400 | — | — | — | — | — | 35 | — |
| Filler: | | | | | | | |
| ZnO | 13.76 | 13 | 13.88 | 13.88 | 12.37 | — | — |
| $Mg(OH)_2$ | — | — | — | — | — | — | 20.7 |
| $CaCO_3$ | — | — | — | — | — | 5 | — |
| $BaSO_4$ | — | — | — | — | — | — | — |
| Modified polyolefin: | | | | | | | |
| E-GMA | 4 | — | — | — | 7 | — | — |
| MAH-PE | — | — | — | 7 | — | — | — |
| Dispersing agent: | | | | | | | |
| H-818 | 0.12 | — | 0.12 | — | 0.13 | — | — |
| P-4 | — | — | — | 0.12 | — | — | — |
| Antioxidant: | | | | | | | |
| CuI | 0.12 | — | — | — | — | — | — |
| IRGANOX | — | — | — | — | 0.5 | — | — |
| Flame retardant: | | | | | | | |
| MCN | — | — | — | — | — | — | 9 |
| Antistatic agent: | | | | | | | |
| PEEA | — | — | — | — | — | — | — |
| Total: | 100 | 100 | 100 | 100 | 100 | 100 | 100 |
| Volume resistivity: ($\Omega \cdot$ cm) | $2 \times 10^{11}$ | $1 \times 10^{12}$ | $3 \times 10^{10}$ | $3 \times 10^{9}$ | $2 \times 10^{12}$ | $3 \times 10^{10}$ | $8 \times 10^{9}$ |
| Type of belt: | ETB | ETB | ETB | ETB | ETB | ITB | ITB |
| Results of evaluation | | | | | | | |
| Flexing resistance: | A | A | A | A | A | A | A |
| Creep resistance: | AA | A | AA | AA | A | AA | AA |
| Environmental resistance difference: | A | A | A | A | A | A | A |
| Initial-stage images: | A | A | A | A | A | A | A |
| After running test: | A | A | A | A | A | A | A |

TABLE 2

| Materials | Comparative Example | | | | | | | | |
|---|---|---|---|---|---|---|---|---|---|
| [part(s)] | 1 | 2 | 3 | 4 | 5 | 6 | 7 | 8 | 9 |
| Polyamide resin: | | | | | | | | | |
| PA610 | — | — | — | — | — | — | — | — | — |
| PA612 | — | — | — | — | — | — | — | — | — |
| PA11 | — | — | — | — | — | — | — | — | — |
| PA12 | — | — | — | — | 87 | 74 | 92 | 45 | 80 |
| PA6 | 74 | — | — | — | — | — | — | — | — |
| PA66 | — | 74 | — | — | — | — | — | — | — |
| PA46 | — | — | 74 | — | — | — | — | — | — |
| MXD6 | — | — | — | 74 | — | — | — | — | — |
| Carbon black: | | | | | | | | | |
| DENKA | 13 | 13 | 13 | 13 | 13 | 13 | — | — | — |
| EC600JD | — | — | — | — | — | — | 3 | — | — |

TABLE 2-continued

| Materials | Comparative Example | | | | | | | | |
|---|---|---|---|---|---|---|---|---|---|
| [part(s)] | 1 | 2 | 3 | 4 | 5 | 6 | 7 | 8 | 9 |
| REGAL400 | — | — | — | — | — | — | — | 30 | — |
| Filler: | | | | | | | | | |
| ZnO | 13 | 13 | 13 | 13 | — | — | 5 | 25 | 10 |
| $Mg(OH)_2$ | — | — | — | — | — | — | — | — | — |
| $CaCO_3$ | — | — | — | — | — | — | — | — | — |
| $BaSO_4$ | — | — | — | — | — | 13 | — | — | — |
| Modified polyolefin: | | | | | | | | | |
| E-GMA | — | — | — | — | — | — | — | — | — |
| MAH-PE | — | — | — | — | — | — | — | — | — |
| Dispersing agent: | | | | | | | | | |
| H-818 | — | — | — | — | — | — | — | — | — |
| P-4 | — | — | — | — | — | — | — | — | — |
| Antioxidant: | | | | | | | | | |
| CuI | — | — | — | — | — | — | — | — | — |
| IRGANOX | — | — | — | — | — | — | — | — | — |
| Flame retardant: | | | | | | | | | |
| MCN | — | — | — | — | — | — | — | — | — |
| Antistatic agent: | | | | | | | | | |
| PEEA | — | — | — | — | — | — | — | — | 10 |
| Total: | 100 | 100 | 100 | 100 | 100 | 100 | 100 | 100 | 100 |
| Volume resistivity: (Ω · cm) | $3 \times 10^{11}$ | $1 \times 10^{11}$ | $2 \times 10^{12}$ | $8 \times 10^{11}$ | $1 \times 10^{12}$ | $1 \times 10^{12}$ | $1 \times 10^{10}$ | $2 \times 10^{11}$ | $2 \times 10^{12}$ |
| Type of belt: | ETB | ETB | ETB | ETB | ETB | ETB | ETB | ETB | ETB |
| Results of evaluation | | | | | | | | | |
| Flexing resistance: | A | A | A | A | A | A | A | C | A |
| Creep resistance: | AA | AA | AA | AA | C | C | B | — | C |
| Environmental resistance difference: | C | C | C | C | A | A | B | A | C |
| Initial-stage images: | C | C | C | C | B | A | B | A | C |
| After running test: | A | A | A | A | C | C | C | C | C |

Explanation of Tables 1 and 2 is given below.

Polyamide resin

"PA": "Polyamide"

PA610: AMILAN CM2001, available from Toray Industries, Inc.

PA612: DIAMID D22, available from Daicel-Degussa Ltd.

PA11: RILSAN BESN 0 TL, available from Atofina Co.

PA12: UBESTA 3030U, available from Ube Industries, Ltd.

PA6: AMILAN CM1041 (LO), available from Toray Industries, Inc.

PA66: LEONA 1700S, available from Asahi Chemical Industry Co., Ltd.

PA46: STANYL TS300, available from DJEP.

MXD6: MX Nylon S6121, available from Mitsubishi Gas Chemical Company, Inc.

Carbon black:

DENKA: DENKA BLACK, powdery product, available from Denki Kagaku Kogyo Kabushiki Kaisha.

EC600JD: KETJEN BLACK EC600JD, available from Lion Corporation.

REGAL 400: Available from Cabot Corp.

Modified polyolefin:

E-GMA: Ethylene/glycidyl methacrylate copolymer, BOND FAST, available from Sumitomo Chemical Co., Ltd.

MAH-PE: Maleic acid modified polyethylene, NUC Polyethylene GA-004, available from Nippon Unicar Co., Ltd.

Dispersing agent:

H-818: Polyglycerol poly-ricinolate, CHIRABAZOL H818, available from Taiyo Kagaku Co., Ltd.

P-4: Polyglycerol stearate, CHIRABAZOL P-4, available from Taiyo Kagaku Co., Ltd.

Antioxidant:

IRGANOX:IRGANOX 245, available from Ciba Specialty Chemicals Inc.

Flame retardant:

MCN: Melamine cyanurate, available from Nissan Chemical Industries, Ltd.

Antistatic agent:

PEEA: Polyether ester amide resin, PELESTAT NC6321, available from Sanyo Chemical Industries, Ltd.

Type of belt:

ETB: Transfer material transporting belt.

ITB: Intermediate transfer belt.

Volume resistivity:

Measured as described previously (in N/N environment; 100 V applied).

Flexing resistance:

In the flexing resistance evaluation test, a sample that neither broke nor cracked even as a result of 1,000,000 reciprocations was evaluated as "A", and a sample that broke or cracked before 1,000,000 reciprocations were finished was evaluated as "C".

Creep resistance:

In the creep resistance evaluation test, a sample having a creep rate of less than 1% was evaluated as "AA"; 1% or more to less than 3%, "A"; 3% or more to less than 4%, "B"; and 4% or more, "C".

Environmental resistance difference:

A sample of less than one figure was evaluated as "A"; one figure or more to less than two figures, "B"; and two figures or more, "C".

Initial-stage images:

A case in which good images were formed in all the environments of N/N, L/L and H/H was evaluated as "A"; good images were formed in the environment of N/N, but some faulty images were seen in the environment of L/L or H/H, "B"; and some faulty images were seen in the environments of L/L and H/H, "C".

After running the test:

A sample showing good results in all the environments of N/N, L/L and H/H was evaluated as "A"; and a sample with creep, breaking or cracking in any of the environments of N/N, L/L and H/H, "C".

This application claims priority from Japanese Patent Application Nos. 2003-399887 filed Nov. 28, 2003, and 2003-422931 filed Dec. 19, 2003, both of which are hereby incorporated by reference herein.

What is claimed is:

1. An electrophotographic endless belt comprising a polyamide resin, carbon black and a filler, wherein the polyamide resin is at least one resin selected from the group consisting of polyamide 612 and polyamide 11, wherein the filler is at least one filler selected from the group consisting of $Mg(OH)_2$ and $CaCO_3$, and wherein weight (A) of the polyamide resin and total weight (B) of the carbon black and the filler are such that a ratio (A:B) is from 90:10 to 50:50.

2. The electrophotographic endless belt according to claim 1, wherein the ratio (A:B) is from 75:25 to 60:40.

3. The electrophotographic endless belt according to claim 1, which further comprises a flame retardant.

4. The electrophotographic endless belt according to claim 1, which is an intermediate transfer belt.

5. The electrophotographic endless belt according to claim 1, further comprising a maleic acid modified polyolefin or a copolymer of glycidyl methacrylate and polyethylene.

6. An electrophotographic apparatus comprising an electrophotographic endless belt comprising a polyamide resin, carbon black and a filler, wherein the polyamide resin is at least one resin selected from the group consisting of polyamide 612 and polyamide 11, wherein the filler is at least one filler selected from the group consisting of $Mg(OH)_2$ and $CaCO_3$, and wherein weight (A) of the polyamide resin and total weight (B) of the carbon black and the filler are such that a ratio (A:B) is from 90:10 to 50:50.

7. A process for producing an electrophotographic endless belt comprising a polyamide resin, carbon black and a filler, the polyamide resin being at least one resin selected from the group consisting of polyamide 612 and polyamide 11, the filler being at least one filler selected from the group consisting of $Mg(OH)_2$ and $CaCO_3$, and weight (A) of polyamide resin and total weight (B) of the carbon black and the filler being at a ratio (A:B) of from 90:10 to 50:50, the process comprising:

a resin introduction step of introducing the polyamide resin into a twin-screw extruder; and a carbon black and filler introduction step of introducing the carbon black and the filler into the twin-screw extruder at the time the polyamide resin having been introduced into the twin-screw extruder through the resin introduction step has melted.

* * * * *

UNITED STATES PATENT AND TRADEMARK OFFICE

CERTIFICATE OF CORRECTION

PATENT NO. : 7,352,984 B2
APPLICATION NO. : 10/986348
DATED : April 1, 2008
INVENTOR(S) : Hidekazu Matsuda et al.

It is certified that error appears in the above-identified patent and that said Letters Patent is hereby corrected as shown below:

COLUMN 7:

Line 56, “less” should read --is less--.

COLUMN 8:

Line 53, “agent” should read --agents--.

COLUMN 10:

Line 55, “time” should read --times--; and
Line 67, “$1x10^{14}$ Ωem.” should read --$1x10^{14}$ Ω·cm.--.

COLUMN 11:

Line 8, “require” should read --requires--;
Line 42, “measurement” should read --measure--; and
Line 56, “ing,” should read --ing--.

COLUMN 15:

Line 10, “for third” should read --for the third--.

COLUMN 16:

Line 34, “on to” should read --onto--.

COLUMN 18:

Line 54, “reciprocation” should read --reciprocations--.

UNITED STATES PATENT AND TRADEMARK OFFICE

CERTIFICATE OF CORRECTION

PATENT NO. : 7,352,984 B2
APPLICATION NO. : 10/986348
DATED : April 1, 2008
INVENTOR(S) : Hidekazu Matsuda et al.

It is certified that error appears in the above-identified patent and that said Letters Patent is hereby corrected as shown below:

COLUMN 26:

Line 26, "polyamide" should read --the polyamide--.

Signed and Sealed this

Second Day of September, 2008

JON W. DUDAS
*Director of the United States Patent and Trademark Office*